US005465494A

United States Patent [19]

Johnston

[11] Patent Number: 5,465,494

[45] Date of Patent: Nov. 14, 1995

[54] TOOL FOR MARKING CHALK LINES AND PLUMB LINES

[76] Inventor: Anthony Johnston, 2 Morton St., Wilmington, Mass. 01887

[21] Appl. No.: 331,057

[22] Filed: Oct. 28, 1994

[51] Int. Cl.[6] ..... B44D 3/38

[52] U.S. Cl. ..... 33/414; 33/413

[58] Field of Search ..... 33/414, 413

[56] References Cited

U.S. PATENT DOCUMENTS 1,338,935 5/1920 Kerr ..... 33/414
1,505,286 8/1924 Peterson ..... 33/414
2,655,728 10/1953 Cook ..... 33/414
2,659,974 11/1953 Scudder ..... 33/414

*Primary Examiner*—Christopher W. Fulton
*Attorney, Agent, or Firm*—Cesari and McKenna

[57] ABSTRACT

A chalk line tool consists of a chalk dispensing compartment, a reel for string and a grinder that rotates with the reel. The chalk dispensing compartment accepts chalk sticks, which the grinder grinds into the chalk dust that coats the string. The grinder consists of a drum with integral grinding teeth. When the drum rotates in the direction that corresponds to the unwinding of the string from the reel, the grinding teeth grind the end of the chalk stick. The chalk tool is easily, quickly and neatly loaded by dropping the chalk stick into the chalk dispensing compartment.

9 Claims, 1 Drawing Sheet

TOOL FOR MARKING CHALK LINES AND PLUMB LINES

FIELD OF THE INVENTION

The invention relates generally to tools used in the construction industry and, more particularly, to tools for making chalk lines and/or plumb lines.

BACKGROUND

Chalk lines are used by carpenters and other building tradesmen to mark straight lines between two end points on a work surface. A line is "drawn" by stretching a chalk-covered string over the work surface between the two designated end points and snapping the string to release the chalk. The chalk line designates a straight line from one end point to the other, since the string that makes the line is stretched tightly between the two end points.

Prior known tools for marking chalk lines each consist essentially of a chalk dust dispenser for storing chalk dust and a reel for string. When the string is wound onto or off of the reel, the string is drawn through, and thus, becomes coated with, the stored chalk dust.

The prior known chalk line tools must be relatively frequently filled with chalk dust. This is a potentially messy operation and, if the user is on a roof, for example, it is also an awkward one. To load the tool, the user retrieves a container of chalk dust that is hanging from his belt, removes the cap from the container and carefully pours the chalk dust from the container into a relatively small opening in a housing that leads to the chalk dust dispensing compartment. It is thus very easy for the user to spill the dust onto the work surface.

The chalk line tool is sized to fit onto a carpenter's belt. Accordingly, it is relatively small and can hold only a limited amount of the chalk dust. The tool may thus have to be re-filled a number of times if, for example, it is being used to mark layout lines for a large roof or lines for the application of siding. This re-filling is not only potentially messy, it is time consuming.

If the user drops the cap from the chalk dust container while he is re-filling the tool, it may become lost. The container cannot then be closed and the dust stored therein will readily absorb moisture from the air. The moisten dust will form clumps, and it can not then be used in the chalk line tool.

Another problem with the prior known chalk line tools is their inefficient operation if the string becomes wet. The wet string draws moisture into the chalk dust dispensing compartment causing the chalk dust stored therein to clump. The tool then becomes unusable.

What is needed is a chalk line tool that is easier to load, requires less frequent re-filling and protects the chalk dust from contamination due to moisture.

SUMMARY

The invention is a chalk line tool that consists of a housing that supports a reel, and a grinder that moves with the reel. The housing includes a chalk dispensing compartment, which accepts a stick of chalk that is formed from compressed chalk dust. The chalk dispensing compartment is situated such that the chalk stick is held in contact with the grinder when the string is withdrawn from the reel. As the reel rotates to release the string the grinder also rotates and grinds the end of the chalk stick. The grinder thus produces the chalk dust that coats the string.

The chalk dispensing compartment holds, in compressed form, approximately twice the amount of chalk that can be stored as chalk dust in the prior known chalk line tools. The tool thus does not require re-loading as often as the prior tools. When re-loading is required, the user simply drops another chalk stick into the chalk dispensing compartment. Accordingly, the tool is quickly and neatly loaded.

The chalk dispensing compartment separates the chalk stick from the string, and thus, keeps the chalk dry even if the string is wet, since the two are not in contact. Further, any moisture brought into the housing by the string is not as readily absorbed by the compressed chalk as it is by the chalk dust used in the prior tools. Accordingly, the chalk stick is not contaminated by the wet string.

The chalk stick may also be lightly sealed to protect it from moisture while it is stored, for example, in the user's belt.

BRIEF DESCRIPTION OF THE DRAWINGS

The above and further advantages of the invention may be better understood by referring to the following description in conjunction with the accompanying drawings, in which.

DETAILED DESCRIPTION OF AN ILLUSTRATIVE EMBODIMENT

Figure 1:
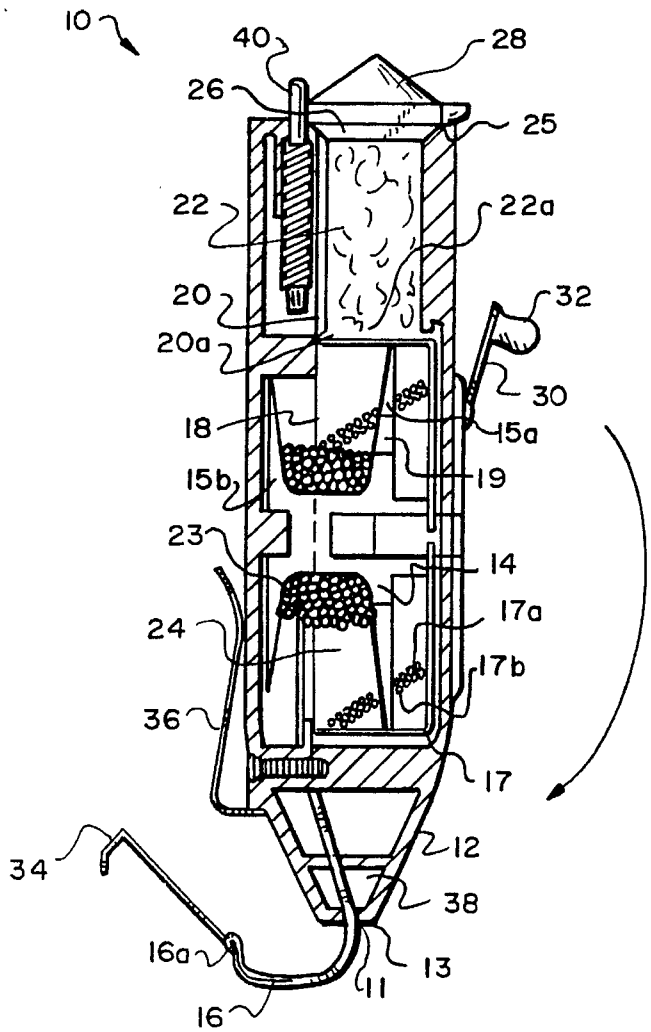
FIG. 1 is a cut-away side view of a chalk line tool that is constructed in accordance with the current invention, illustrating the internal mechanisms of the tool and the housing.

Referring now to FIG. 1, a chalk line tool 10 consists of a housing 12 that supports a reel 14 for string 16 and a grinder 18. The housing 12 includes a chalk dispensing compartment 20 that accepts a chalk stick 22. One end 20*a* of the dispensing compartment 20 is open, such that an end 22*a* of the chalk stick 22 contacts the grinder 18 when the tool is in use. The reel 14 rotates to release the string 16 through an opening 11 at one end 13 of the housing 12. As it does so, it causes the grinder 18 to rotate and grind the end 22*a* of the chalk stick 22. The grinder 18 thus produces the dust 23 that coats the string 16.

The grinder 18, which consists of an open-ended drum 17 with integral strips 17*a* of angled grinding teeth 17*b*, is attached to and rotates with the reel 14. The grinding teeth 17*b* contact the chalk stick 22 as the drum 17 rotates, and grind the chalk stick 22 into dust. Alternatively, the teeth may be angled such that they grind the chalk only when the drum rotates as the string is pulled from the reel. In this alternative arrangement, the teeth 17*b* tend not to grind the chalk stick when the drum 17 rotates to re-wind the string 16.

The teeth 17*b* are angled to pull the chalk dust 23 to the interior of the drum 17. The dust 23 falls through the open end of the drum 17, and onto the string 16 that is wrapped on the reel. End plates 15*a* and 15*b* of the reel, which essentially direct the string 16 onto the reel, also corral the chalk dust to the string. The end plate 15*a* attaches to the drum 17, to give it added support. The plate includes holes 19 that allow dust that tends to collect on the outside of the plate 15*a* to fall into the chamber 24.

The chalk stick 22 is loaded into the chalk dispensing compartment 20 through an opening 25 in the housing. A rubber gasket 26 and an end cap 28 operate together to close the opening 25 and essentially seal the dispensing compartment 20. The end cap 28 is held in place on the gasket 26 by a spring-controlled arm 40, as discussed in more detail below with reference to FIG. 2.

To load the chalk line tool 10, a user slides the end cap 28 away from the gasket 26 to reveal the open end of the dispensing compartment 20. He then drops a chalk stick 22 into the dispensing compartment 20 and slides the end cap 28 back into place on the gasket 26. The tool is thus loaded easily and quickly, and without spilling chalk dust onto the work area or the user.

To mark a line, a user secures a free end 16*a* of the string 16 to a designated end point (not shown), preferably by hooking an attached anchorage clip 34 around, for example, a strategically placed nail. The user then moves the tool toward the second end point (not shown). This causes the line to pull from the reel 14, and thus, the reel to rotate. As the reel 14 rotates, it causes the drum 17 to rotate. The drum 17 then grinds the chalk stick 22, to produce a fresh supply of the chalk dust 23.

As the string 16 moves from the reel 14, it passes through the chamber 24 and becomes coated with the chalk dust 23. When the string 16 is stretched between the two end points, the user snaps the string 16 to release the chalk dust and mark the line.

The handle 30 preferably includes at its free end a knob 32, which slides into a detent (not shown) in the housing to lock the reel against rotation. The user thus slides the knob 32 into the detent before snapping the string 16 to release the chalk dust.

To prevent chalk dust from escaping from the opening 11 at the end 13 of the housing, a felt gasket 38 is positioned at the opening 11.

The tool 10 may include a clip 36, so that the tool can be stored on the user's belt.

Figure 2:
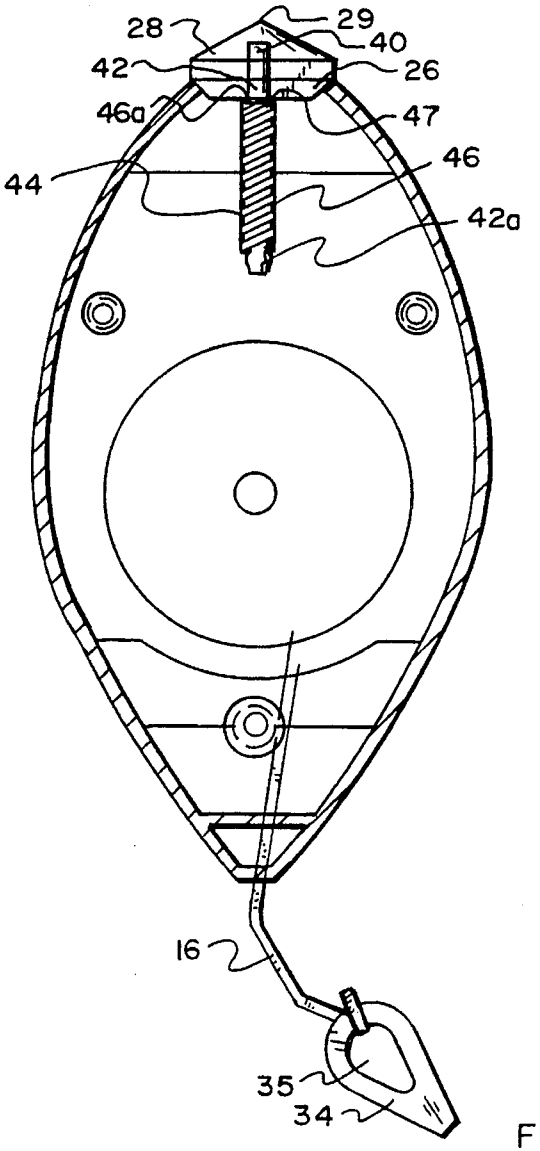
FIG. 2 is cut-away top view of the chalk line tool depicted a FIG. 1.

Referring now to FIG. 2, the spring-controlled arm 40 is depicted in more detail. The top of the housing 12 is cut-away to reveal the sections of the arm that are otherwise hidden from view. The spring-loaded arm 40 consists of a shaft 42, a spring 44 that is wrapped around the shaft and a tube 46 that essentially houses the spring. The tube 46 has at a top end 46*a* an opening 47 that is wide enough to allow the shaft 42 to move through it and yet narrow enough to prevent the spring from exiting the end 46*a* of the tube. The shaft 42 has a crimped end 42*a*, which prevents that end from sliding through the spring 44.

To slide the end cap 28 from the gasket 26, the user pulls upwardly on the shaft 42, which compresses the spring 44. He then maneuvers the handle to direct the end cap 28 away from the gasket 26, rotating the shaft as necessary. When the user releases the shaft 42, the spring 44 rebounds and pulls the shaft, and thus, the end cap 28 away from the gasket. To slide the end cap 28 onto the gasket 26, the user again pulls on the shaft 42 to compress the spring 44 slightly, and maneuvers the end cap into position above the gasket. The user then releases the shaft 42 and the spring 44 pulls the end cap into place.

The end cap 28 preferably has an outwardly pointing end 29. With such an end, the tool 10 can also be used to mark a plumb line.

This view of the anchorage clip 34 depicts a cut-out 35 that may be slipped over the end of, for example, the nail (not shown) to secure the end of the string 16 to the marker that designates the first end point of the chalk line.

In summary, the chalk line tool 10 is easier to load than prior known tools—a user simply drops a chalk stick into the chalk dispensing compartment. The tool thus loads faster, neater and less awkwardly than prior known chalk line tools. Once loaded, the tool does not require re-loading as often as the prior known tools, since the chalk sticks used in the tool produce enough chalk dust to make approximately twice the length of chalk line as the prior known tools.

The foregoing description has been limited to a specific embodiment of this invention. It will be apparent, however, that variations and modifications may be made to the invention, with the attainment of some or all of its advantages. Therefore, it is the object of the appended claims to cover all such variations and modifications as come within the true spirit and scope of the invention.

What is claimed is:

1. A chalk line tool including:

A. a housing with a first opening through which string is fed, the housing including a chalk dispensing compartment for holding a chalk stick;

B. a reel, which rotates to pull the string into and release the string from the housing;

C. a grinder connected to rotate with the reel, the grinder grinding the chalk stick into chalk dust, the reel being positioned relative to the grinder means such that the string released from the reel travels through the chalk dust produced by the grinder.

2. The chalk line tool of claim 1, wherein the grinder consists of an open-ended drum with integral grinding teeth.

3. The chalk line tool of claim 2, wherein the reel includes two end plates that direct the string onto the reel and the chalk dust produced by the grinder to the string.

4. The chalk line tool of claim 1, wherein the housing includes a. an opening through which chalk sticks are fed to the chalk dispensing compartment; and b. an end cap that closes the opening to the dispensing compartment, the end cap being held in place over the opening by a spring-controlled arm.

5. The chalk line tool of claim 4, wherein the end cap includes an outwardly pointing end.

6. The chalk line tool of claim 4, wherein the spring-controlled arm includes:

a. a spiral spring having a first end and a second end;

b. a tube for housing the spring, the tube having at a top end an opening that prevents the spring from exiting the tube; and c. a shaft that extends through the spiral spring, the shaft having with a first end and a second end, the first end of the shaft extending from the tube and the second end of the shaft being crimped to prevent the end from entering the spiral spring, the spring compressing when the shaft is pulled upwardly from the top of the tube and rebounding when the shaft is released.

7. A chalk line tool including:

A. a housing having a chalk dispensing compartment for storing one or more sticks of chalk;

B. a reel rotatably supported by the housing, for storing a string;

C. a grinder integral to the reel, for grinding the ends of the chalk sticks to produce chalk dust, the grinder grinding the ends of the chalk sticks when the reel rotates to release the string.

8. The chalk line tool of claim 7, wherein the grinder is positioned within the housing such that the end of at least one of the chalk sticks is in contact with the grinder means when the tool is in use.

9. The chalk line tool of claim 7, wherein the reel is positioned within the housing such that the string drawn from the reel travels through the chalk dust produced by the grinder.

* * * * *